US008839570B1

(12) United States Patent
Petrello et al.

(10) Patent No.: US 8,839,570 B1
(45) Date of Patent: Sep. 23, 2014

(54) SELF-ELEVATING MAST EMPLOYING ACTUATORS

(71) Applicant: Nabors Drilling International Limited, Hamilton (BM)

(72) Inventors: Anthony Petrello, Houston, TX (US); Padira Reddy, Richmond, TX (US); Ashish Gupta, Houston, TX (US); Sean M. Bailey, Willis, TX (US)

(73) Assignee: Nabors Drilling International Limited, Hamilton (BM)

( * ) Notice: Subject to any disclaimer, the term of this patent is extended or adjusted under 35 U.S.C. 154(b) by 0 days.

(21) Appl. No.: 13/799,903

(22) Filed: Mar. 13, 2013

(51) Int. Cl.

| | |
|---|---|
| ***B66C 23/06*** | (2006.01) |
| ***E04H 12/34*** | (2006.01) |
| ***B66F 3/24*** | (2006.01) |
| ***E21B 15/00*** | (2006.01) |

(52) U.S. Cl.
CPC ..... *E04H 12/344* (2013.01); *B66F 3/24* (2013.01); *E21B 15/00* (2013.01)
USPC ..... 52/115; 52/121

(58) Field of Classification Search
CPC ..... E04H 12/00; E21B 15/00
USPC ..... 52/115, 121, 123.1, 118
See application file for complete search history.

(56) References Cited

U.S. PATENT DOCUMENTS

| | | | | | |
|---|---|---|---|---|---|
| 1,360,131 | A | * | 11/1920 | Miller | 52/123.1 |
| 1,644,499 | A | * | 10/1927 | Trout | 52/123.1 |
| 2,948,363 | A | * | 8/1960 | Hopfeld | 182/141 |
| 3,194,412 | A | * | 7/1965 | Kerridge | 212/176 |
| 4,196,814 | A | * | 4/1980 | Reich | 212/204 |
| 5,450,695 | A | * | 9/1995 | Desai | 52/118 |
| 5,490,364 | A | * | 2/1996 | Desai et al. | 52/637 |

* cited by examiner

*Primary Examiner* — Basil Katcheves
(74) *Attorney, Agent, or Firm* — Haynes and Boone, LLP

(57) ABSTRACT

A method includes accommodating a first mast section of a mast on a mast cart below a floor of a platform, the mast comprising a plurality of mast sections, and elevating, using actuators located on the mast cart, the first mast section through an opening in the platform. The method also includes attaching the first mast section to the platform using a plurality of holding locks located on the platform, accommodating a second mast section on the mast cart below the floor of the platform, and elevating the second mast section to the first mast section using the actuators. The method also includes attaching the first mast section to the second mast section, detaching the first mast section from the platform, elevating the first mast section and the second mast section through the opening using the actuators, and attaching the second mast section to the platform using the holding locks.

22 Claims, 11 Drawing Sheets

EXTEND ACTUATORS TO LIFT THE MAST SECTION 18b, CONNECT 18a AND 18b, AND DISENGAGE 18a FROM THE PLATFORM

38f

38h

ARRANGE ROTARY SECTION 18f, IN MAST CART

38i

EXTEND ACTUATORS TO ENGAGE COUPLINGS AND MAST SECTION 18e, DETACH MAST SECTION 18e FROM PLATFORM, LOWER MAST SECTIONS 18a-18e TO ROTARY SECTION 18f, AND CONNECT MAST SECTION 18e-18f

38j

EXTEND ACTUATORS TO LIFT MAST SECTIONS 18a-18f AND ATTACH MAST SECTION 18f TO PLATFORM

SELF-ELEVATING MAST EMPLOYING ACTUATORS

BACKGROUND OF THE DISCLOSURE

The present disclosure relates in general to drilling rigs, and in particular to assembling a drilling mast using self-elevating actuators.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
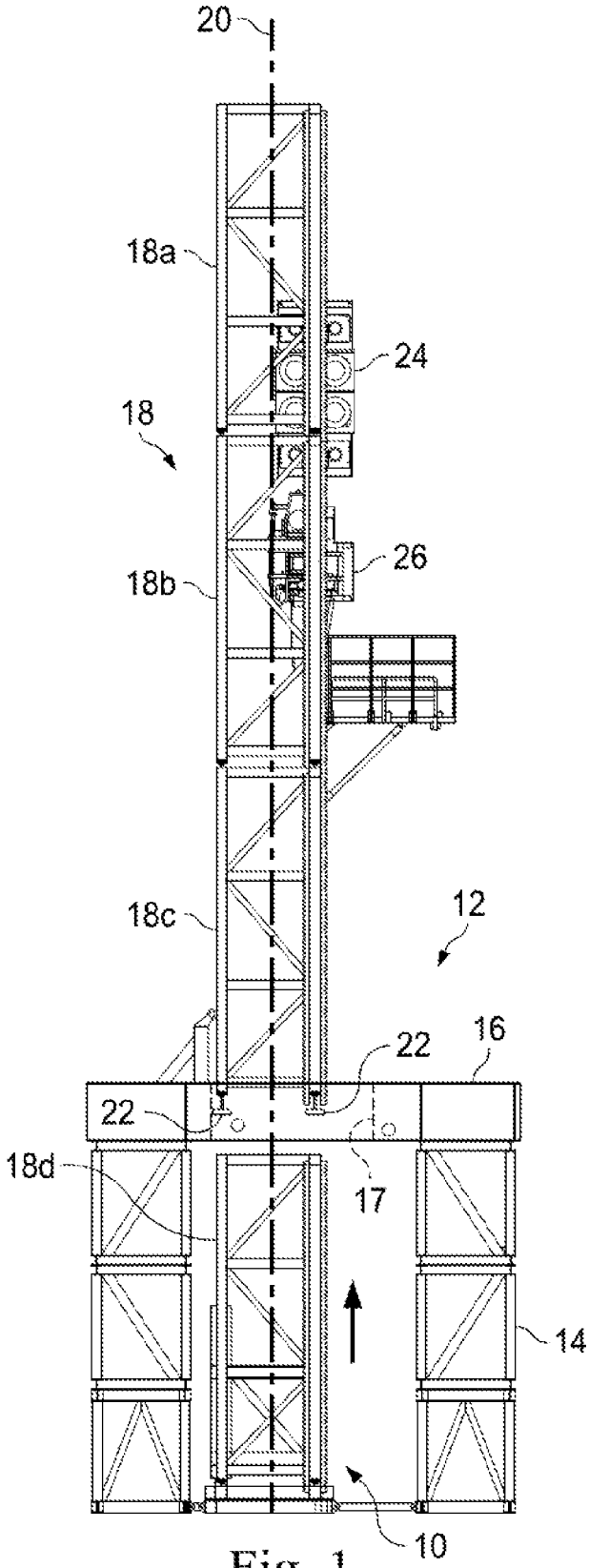
FIG. 1 is a side elevational view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
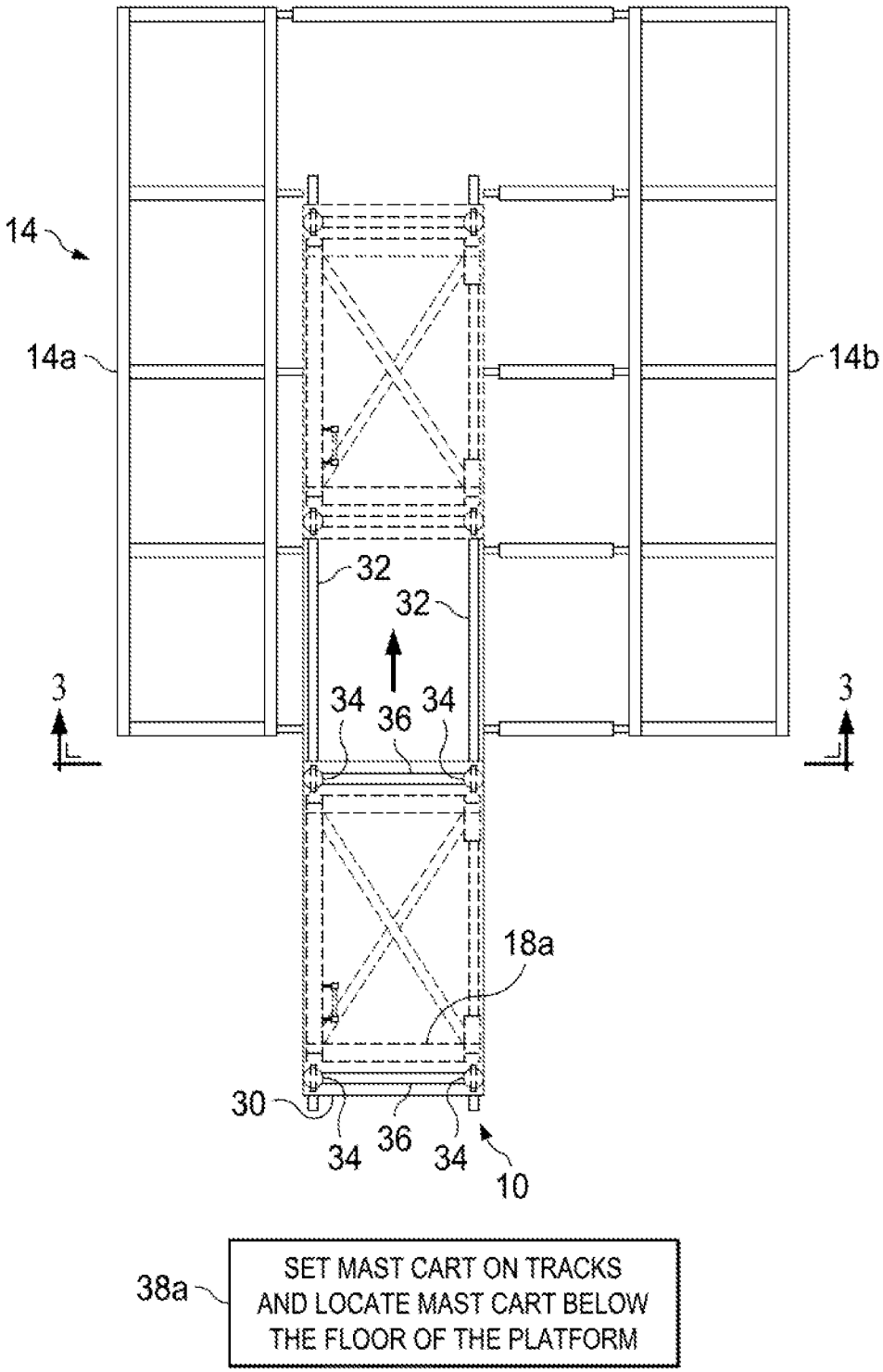
FIG. 2 is a plan view of the apparatus shown in FIG. 1 according to one or more aspects of the present disclosure.

Referring to FIG. 1, illustrated is a side elevational view of apparatus 10. The apparatus 10 may be used during the construction of a land-based drilling rig 12. However, in several exemplary embodiments, instead of a land-based drilling rig, the apparatus 10 may be used in connection with any type of drilling rig, such as a jack-up rig, a semi-submersible rig, a drill ship, a coil tubing rig, or a casing drilling rig, among others. The drilling rig 12, which includes a platform 14 includes a rig floor 16 that is adapted to be positioned above a wellbore (not shown), which can be a wellbore or a planned wellbore. There is an opening 17 formed in the rig floor 16. The opening 17 is generally sized and dimensioned to receive a mast 18 therethrough. In some embodiments, the opening 17 has an axis generally coaxial with the wellbore. In another embodiment, the opening 17 has an axis parallel with the well bore. In another embodiment, the opening 17 is generally disposed above the well bore when the apparatus is in operation. The drilling rig 12 includes a mast 18 having multiple mast sections 18*a*, 18*b*, 18*c*, 18*d*, 18*e*, and 18*f*. The mast sections 18*a*, 18*b*, 18*c*, 18*d*, 18*e*, and 18*f* are temporarily attached together. In one embodiment, the mast sections 18*a*, 18*b*, 18*c*, 18*d*, 18*e*, and 18*f* are temporarily attached using a bolt and pin system, wherein an opening on a lower section of mast section 18*a* and an opening on an upper section of mast section 18*b* are attached with a bolt and pin (not shown). This permits the methods described herein to be reversed to disassemble the apparatus to facilitate movement thereof to a new wellbore or other location. In one embodiment, however, the mast sections are permanently joined as they are connected. In some embodiments, the mast 18 extends through the opening 17. The mast 18 is coupled to the platform 14, and extends longitudinally, typically vertically or at least substantially vertically, along an axis 20. In one embodiment, the mast 18 is coupled to the platform 14 with holding locks 22. In one embodiment, the holding locks 22 are located near the perimeter of the opening 17. As shown in FIG. 2, the holding locks 22 may temporarily attach to a lower section of mast section 18*c* without impeding the attachment of mast section 18*c* and 18*d*. A carriage frame 24 is movably coupled to the mast 18. A top drive 26 may be coupled to the carriage 24.

Referring to FIG. 2, illustrated is a plan view of the apparatus 10 and the platform 14. In one embodiment, the apparatus or mast cart 10 includes a base 30 configured to temporarily couple to tracks or slides 32 for movement of the apparatus 10. These permit the apparatus 10 to be arranged in a position under the platform 14 to receive and/or position mast sections 18*a* etc. as further described herein. In one embodiment, the base 30 is rectangular, while in others it is square, trapezoidal, a parallelogram, or other quadrilateral shape. The apparatus 10 has a plurality of actuators 34 typically extending vertically, or in a vertical direction, from the base 30. That is, each longitudinal axis of the plurality of actuators 34 is typically parallel or "at least substantially" (e.g., within 10 degrees) parallel with the axis 20. In one embodiment, each of the plurality of actuators 34 is located near each corner of the rectangular base 30. Supports 36 typically extend between and are connected to the actuators 34 to provide structural stability to the apparatus 10. In an exemplary embodiment, the actuators 34 are, or include, telescoping, hydraulic cylinders. In several exemplary embodiments, each of the actuators 34 is, includes, or is part of, a hydraulic actuator, an electromagnetic actuator, a pneumatic actuator, a linear actuator, and/or any combination thereof. When actuated, the actuators 34 apply a force in a vertical direction, or an at least substantially vertical direction. In one embodiment, the actuators 34 are adapted to apply a force in the vertical direction. In one embodiment, the actuators 34 extend or retract their respective lengths along a vertical or at least substantially vertical axis. In one embodiment, the apparatus 10 accommodates a mast section, such as 18*a*, 18*b*, 18*c* or 18*d*, etc., so that the mast sections 18*a*, 18*b*, 18*c*, 18*d*, 18*e*, and 18*f* may be placed on the base 30. In one embodiment, the apparatus 10 is adapted to accommodate a mast section, such as 18*a*, 18*b*, 18*c* or 18*d*, etc., so that the mast sections 18*a*, 18*b*, 18*c*, 18*d*, 18*e*, and 18*f* may be placed on the base 30. The platform 14 may include a row of sub boxes 14*a* and 14*b*. The tracks or slides 32 extend into a passage defined by the row of sub boxes 14*a* and 14*b* and below the rig floor 16 (not shown in FIG. 2). The apparatus 10, being coupled to the tracks or slides 32, may be moved into a position located between the sub boxes 14*a* and 14*b* and under the opening 17 (not shown in FIG. 2). In one embodiment, the apparatus 10 is secured in this position using braces. As shown in FIG. 2, in step 38*a* the apparatus 10 is placed on the tracks or slides 32 and located under the floor 16 of the platform 14.

Figure 3:
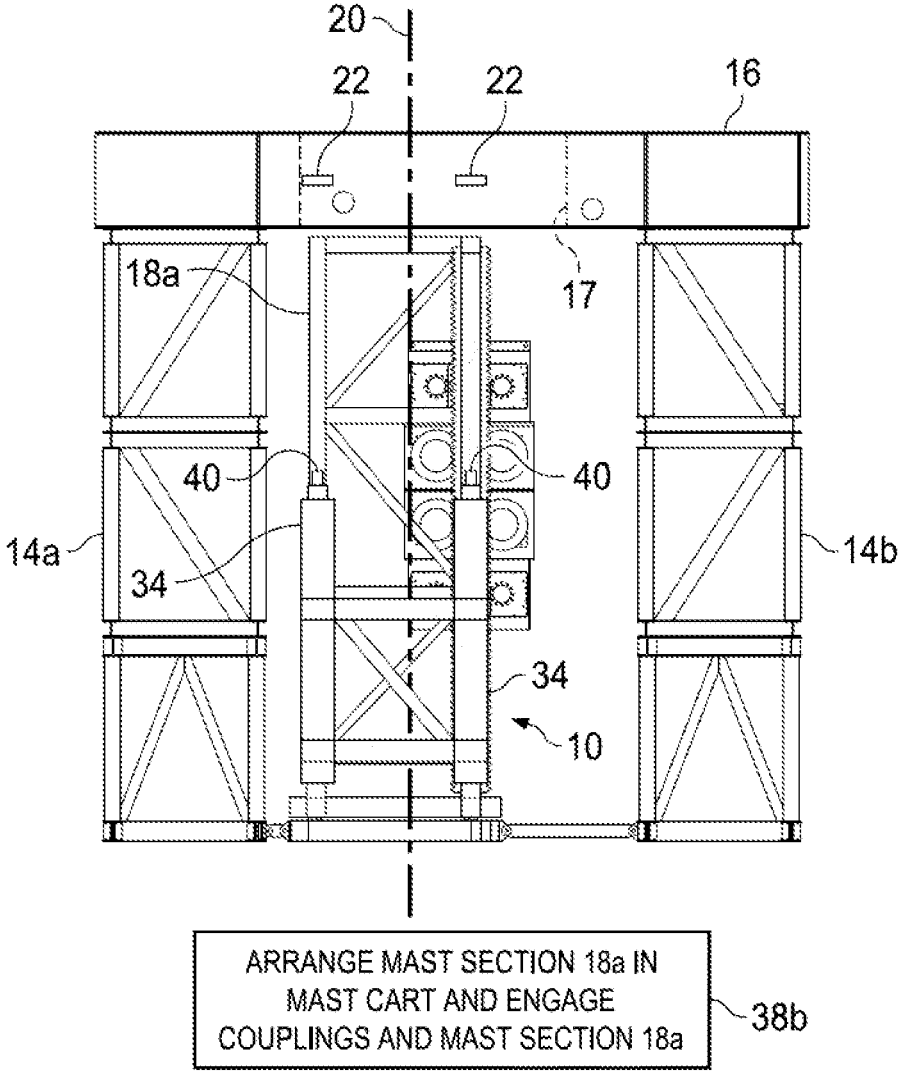
FIG. 3 is a side elevational view of the apparatus shown in FIG. 1 according to one or more aspects of the present disclosure.

Referring to FIG. 3, illustrated is an elevation view of the apparatus 10 while located under the floor 16 of the platform 14. The mast section 18*a*, or uppermost mast section, is arranged on the base 30 with the mast section 18*a* in a vertical position. That is, a longitudinal axis of the mast section 18*a* is at least substantially parallel or parallel to the axis 20. The apparatus 10 is located such that the mast section 18*a* is located beneath the opening 17 of the rig floor 16. A coupling 40 is located on each actuator 34 and temporarily engages the mast section 18*a*. In one embodiment, the coupling 40 is arranged to temporarily engage the mast section 18*a*. As shown, in step 38*b* the mast section 18*a* is arranged in association with the apparatus 10 and the actuators 34 engage the mast section 18*a*.

Figure 4:
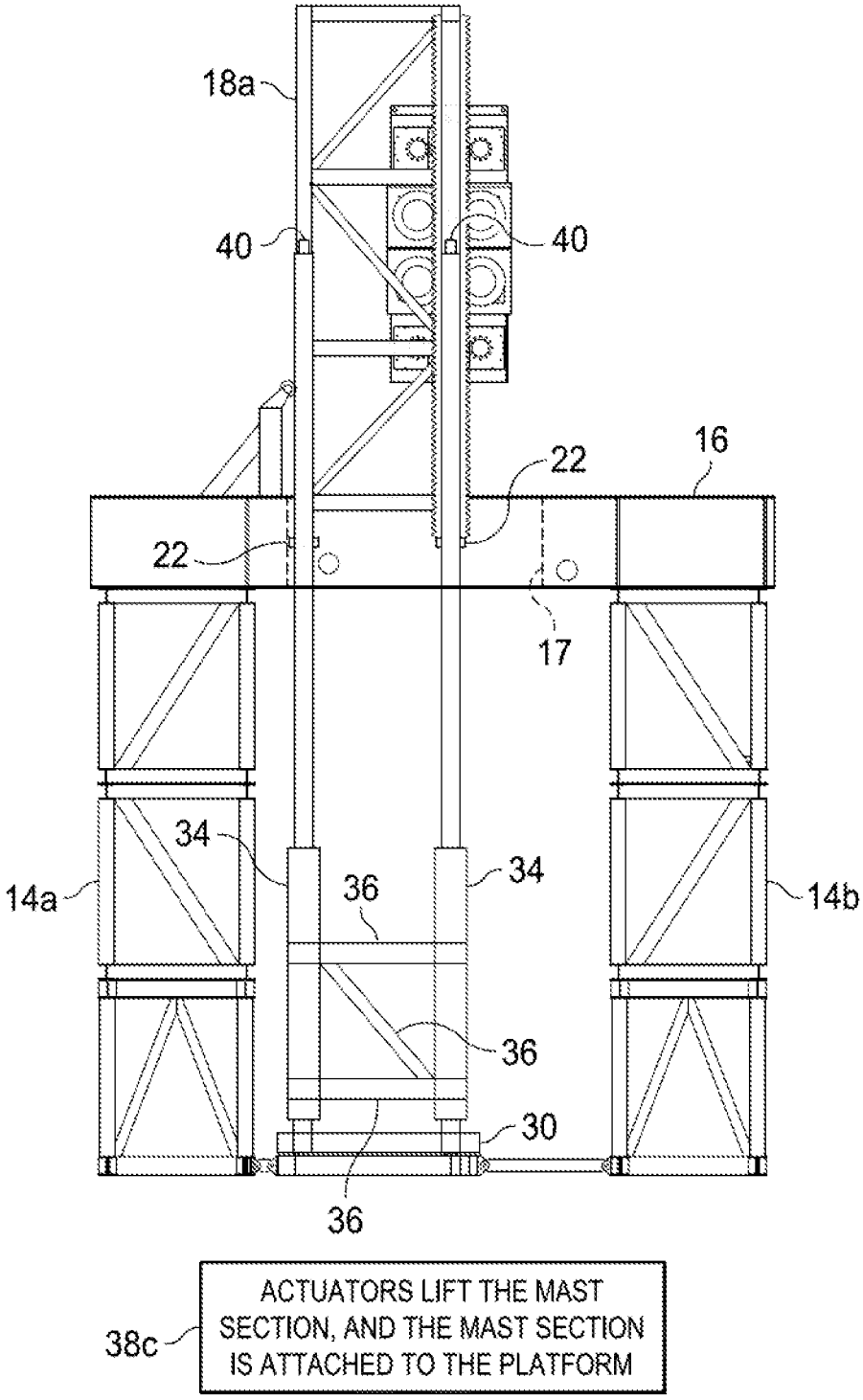
FIG. 4 is a side elevational view of the apparatus shown in FIG. 1 according to one or more aspects of the present disclosure.

Referring to FIG. 4, illustrated is an elevation view of the apparatus 10 while in an extension position. With each coupling 40 engaged to the mast section 18*a*, the force generated from the actuators 34 is conveyed to the mast section 18*a* to lift the mast section 18*a* to and through the opening 17 to a first height. The first height is a position at which the lower section of the mast section 18*a* may be attached to the platform 14 using the holding locks 22. Each coupling 40 and at least a portion of the mast section 18*a* extend through the opening 17 and above the drilling floor 16. As shown, in step 38*c* the actuators 34 elevate or lift the mast section 18*a*, which is then attached to the platform 14 using the holding locks 22.

Figure 5:
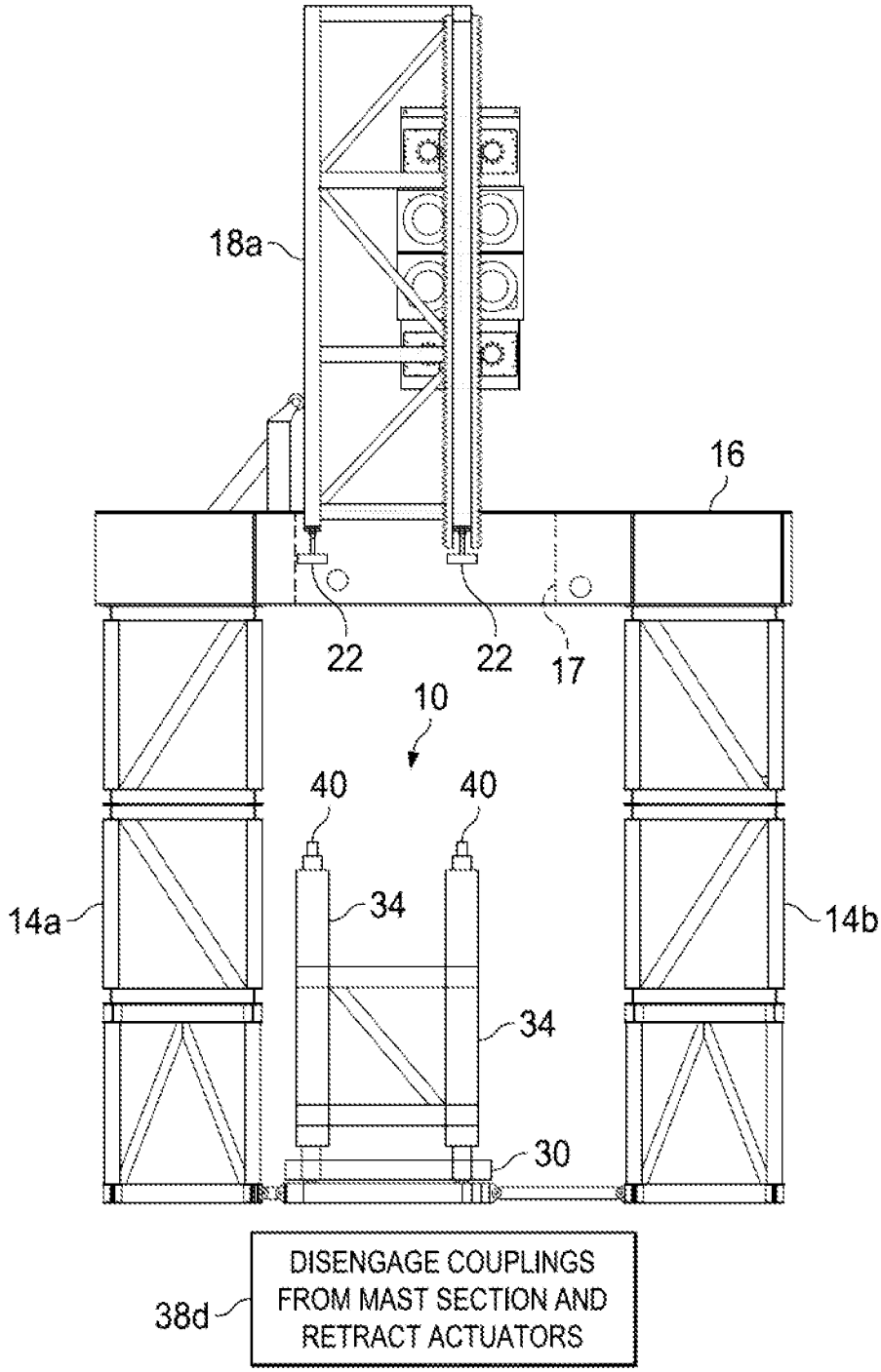
FIG. 5 is a side elevational view of the apparatus shown in FIG. 1 according to one or more aspects of the present disclosure.

Referring to FIG. 5, illustrated is an elevation view of the apparatus 10. After the mast section 18*a* is attached to the platform in the step 38*c*, each coupling 40 disengages from the mast section 18*a* and the actuators 34 are retracted in preparation to accommodate a further mast section 18*b*, 18*c*, or 18*d* as shown in step 38*d*.

Figure 6:
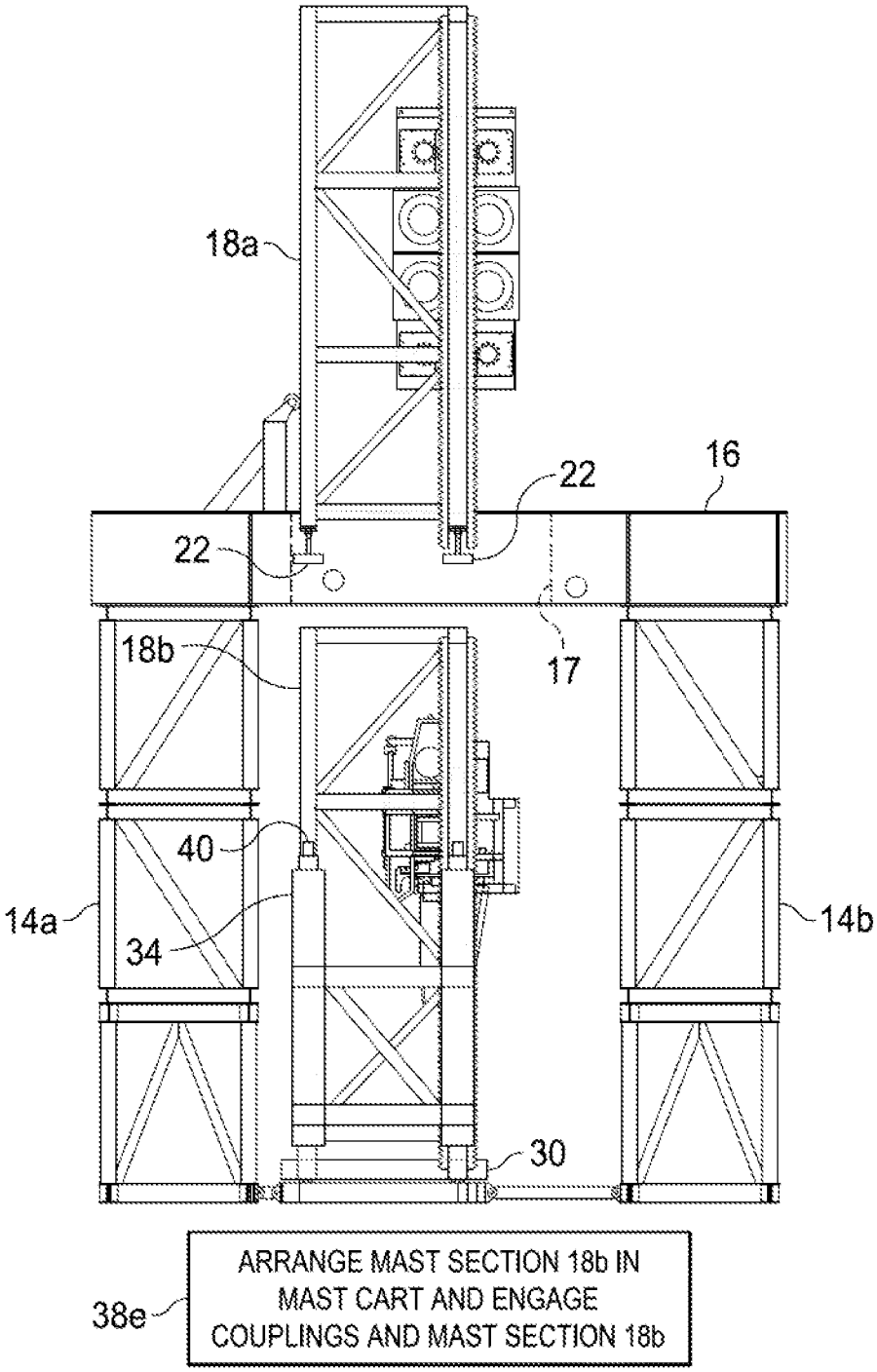
FIG. 6 is a side elevational view of the apparatus shown in FIG. 1 according to one or more aspects of the present disclosure.
Figure 7:
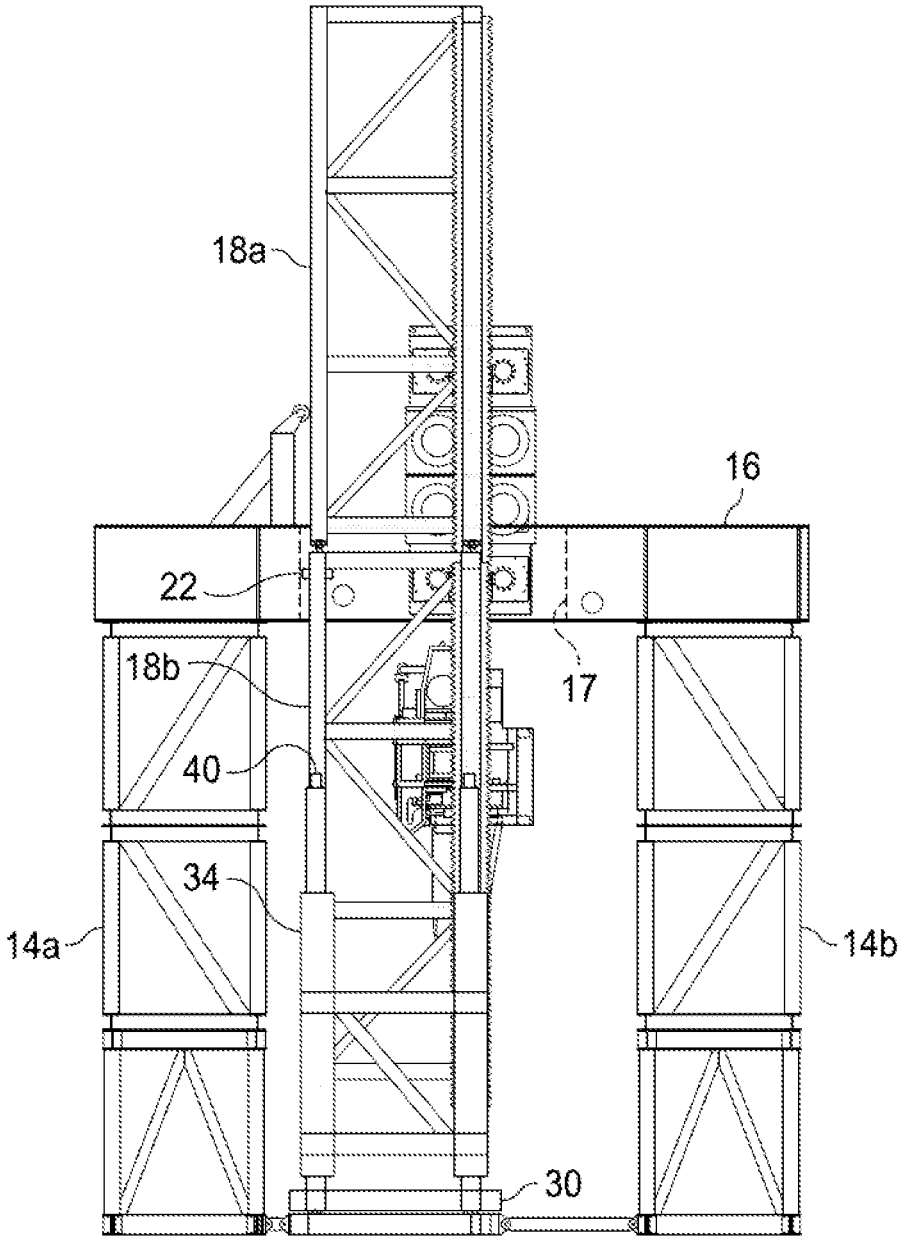
FIG. 7 is a side elevational view of the apparatus shown in FIG. 1 according to one or more aspects of the present disclosure.
Figure 8:
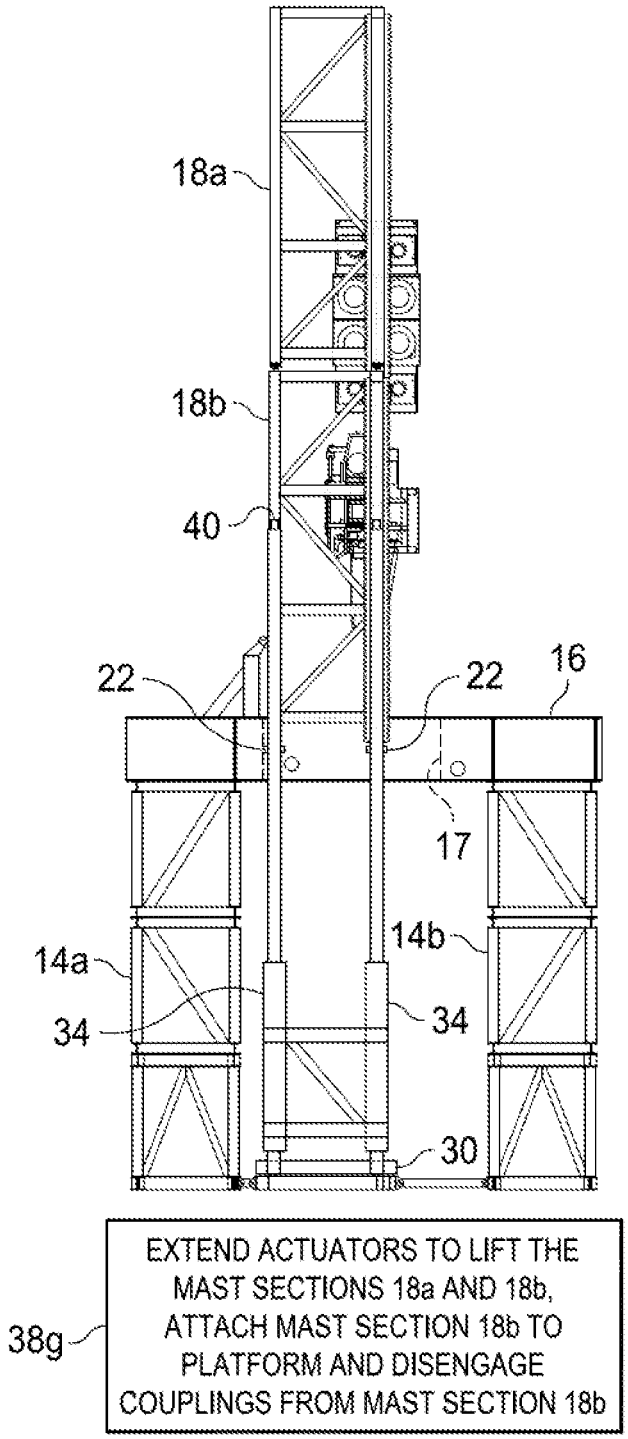
FIG. 8 is a side elevational view of the apparatus shown in FIG. 1 according to one or more aspects of the present disclosure.

Referring to FIGS. 6-8, illustrated is an elevation view of the apparatus 10 accommodating the mast section 18*b*. As shown, at step 38*e* the apparatus 10 accommodates the mast section 18*b*, which is arranged so that each coupling 40 engages mast section 18*b*. As shown in step 38*f*, the actuators 34 elevate, using the couplings 40, the mast section 18*b* towards the floor 16 and the mast section 18*a*. The actuators 34 raise the mast section 18*b* to a second height. The section height is a position at which the upper section of the mast section 18*b* may be attached to the lower section of the mast section 18*a* using the bolt and pin or other suitable fastener. After the mast section 18*a* and the mast section 18*b* are attached, the mast section 18*a* is detached from the platform 14 using the holding locks 22. After completing the step 38*f*, the actuators 34 lift the mast section 18*b*, along with the mast section 18*a*, until a lower section of mast section 18*b* can be attached to the platform 14 using the holding locks 22, as shown in FIG. 8. After the mast section 18*b* is attached to the platform 14, each coupling 40 disengages from the mast section 18*b* and the actuators 34 return to the retracted position. The steps 38*e*, 38*f*, 38*g* add additional mast sections to the mast 18, and these steps are repeated using a next mast section 18*c*, 18*d*, 18*e*, etc. until the mast section 18*f*, which is a rotary section of the mast 18 that connects to the platform 14 during drilling, is connected. In one embodiment, the rotary section 18*f* may comprise a rotating system or rotating equipment, such as a rotary-table system, turntable, or master bushing and Kelly drive bushing.

Figure 9:
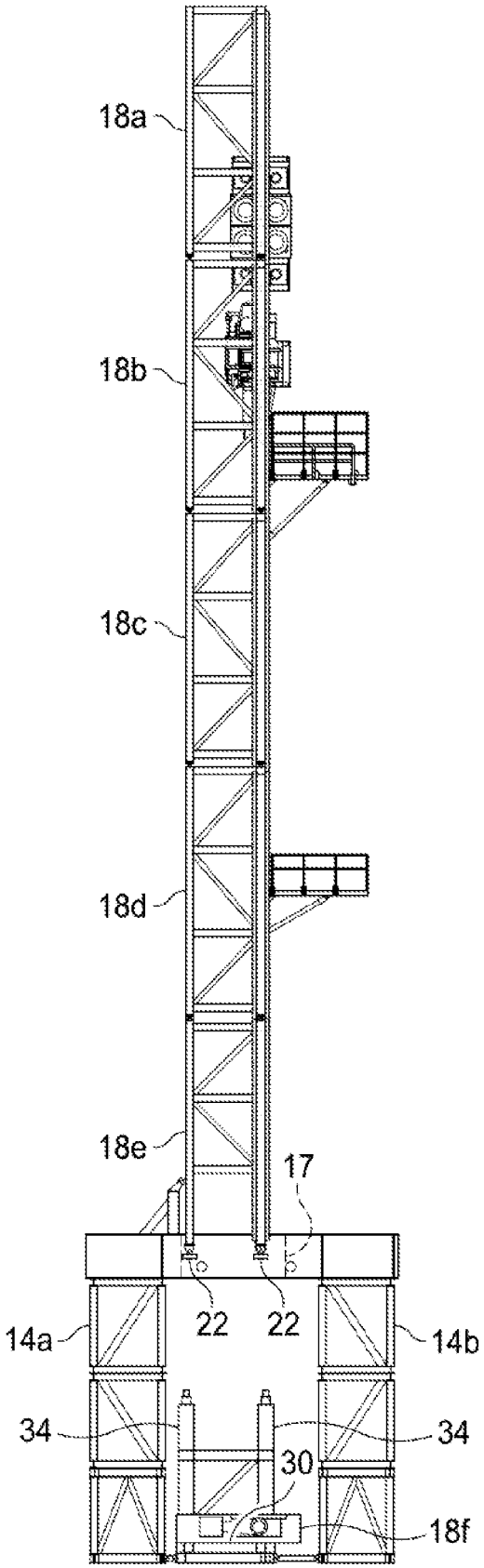
FIG. 9 is a side elevational view of the apparatus shown in FIG. 1 according to one or more aspects of the present disclosure.
Figure 10:
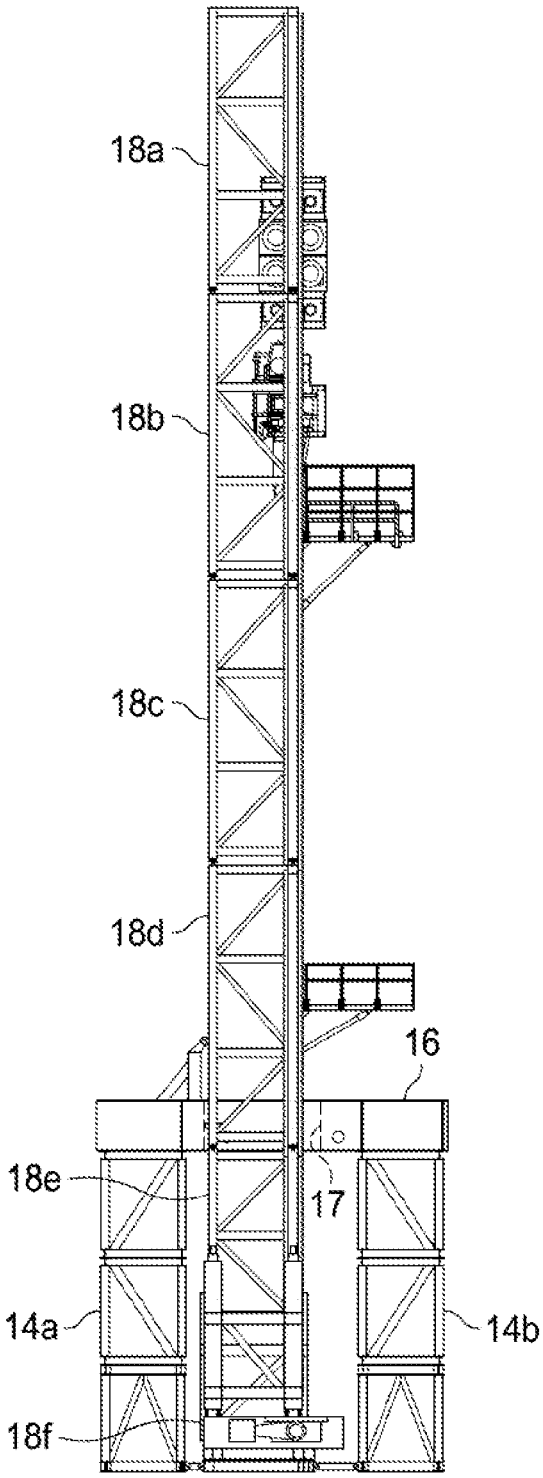
FIG. 10 is a side elevational view of the apparatus shown in FIG. 1 according to one or more aspects of the present disclosure.
Figure 11:
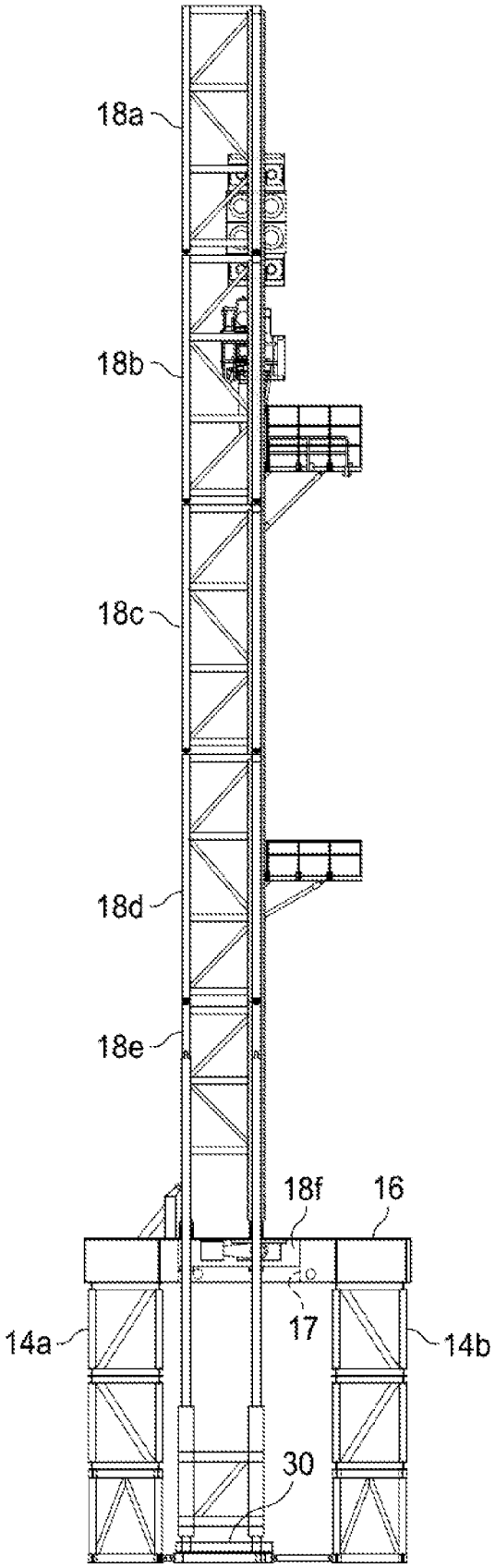
FIG. 11 is a side elevational view of the apparatus shown in FIG. 1 according to one or more aspects of the present disclosure.

Referring to FIGS. 9-11, illustrated is an elevation view of the apparatus 10 accommodating the rotary section 18*f*. After all required mast sections 18*a*, 18*b*, 18*c*, 18*d*, and 18*e* are attached together and attached to the platform 14, the rotary section 18*f* is arranged on the apparatus 10, as shown in step 38*h*. The actuators then extend in a vertical direction and each coupling 40 engages the then-lowest mast section 18*e* (attached to the platform using the holding locks 22). The mast section 18*e* is then detached from the platform 14. The actuators 34 then lower the mast sections 18*a*, 18*b*, 18*c*, 18*d*, and 18*e* until the mast section 18*e* can be attached to the rotary section 18*f* (the rotary section 18*f* is not lifted by the actuators at this time). The mast sections 18*e* and 18*f* are attached together using bolts and pins at step 38*i*, or another suitable type of fastener, which is typically temporary. The actuators 34 extend to lift the mast sections 18*a*, 18*b*, 18*c*, 18*d*, 18*e*, and 18*f* until the rotary section 18*f* can be coupled to the platform 14 using the holding locks 22 at step 38*j*. After the step 38*j*, each coupling 40 disengages from the mast section 18*e* and the actuators retract. The apparatus 10 may then be removed.

The present disclosure introduces an apparatus including a base adapted to accommodate a first mast section; a plurality of actuators extending in a vertical direction from the base, the actuators adapted to apply a force in the vertical direction and being extendable and retractable along a vertical axis; and a coupling located on a corresponding actuator from the plurality of actuators, the coupling arranged to temporarily engage the first mast section and to convey the force from the corresponding actuator to move the first mast section along the vertical axis in connection with extension of the actuators. In one aspect, the actuators include hydraulically telescoping cylinders. In one aspect, the base is a quadrilateral surface having four corners and having each corresponding actuator located near each corner. In another aspect, the apparatus further includes a platform including at least two vertical supports and a floor that connects laterally between an upper portion of each vertical support; wherein the first mast section has an upper section and a lower section, and a second mast section has an upper section and a lower section; wherein the base is located below the floor of the platform and between the vertical supports; wherein the platform has a plurality of holding locks to attach the lower section of the first mast section to the platform; wherein the actuators are extendable to at least a first height corresponding to a first position at which the lower section of the first mast section may be attached to the platform using the plurality of holding locks; and wherein the actuators are extendable to a second height corresponding to a second position at which an upper section of the second mast section may be attached to the lower section of the first mast section. In another aspect, the floor has an opening through which the first mast section, the actuators, and the couplings can extend. In another aspect, the plurality of holding locks are located near the opening, and each holding lock corresponds to one of the actuators. In another aspect, the actuators are extendable to at least a third height corresponding to a third position at which the lower section of the second mast section may be attached to a rotary section; and wherein the actuators are extendable to a fourth height corresponding to a fourth position at which the rotary section may be attached to the platform using the plurality of holding locks. In another aspect, each coupling is located on an upper portion of the corresponding actuator.

The present disclosure also introduces a method including locating a mast cart below a floor of a platform, the platform including a plurality of holding locks adapted to attach a mast thereto; arranging a first mast section of the mast on the mast cart, wherein the mast includes a plurality of mast sections, with the first mast section having a first mast upper section and a first mast lower section; engaging the first mast section to a plurality of couplings, each coupling located on a corresponding actuator of a plurality of actuators that extends vertically from the mast cart, with the plurality of actuators extending and retracting, and exerting a force, in the vertical direction; extending the actuators to lift the first mast section, using the couplings to convey the force exerted by the actuators, in a vertical direction towards the floor; attaching the first mast to the platform using the plurality of holding locks; disengaging the plurality of couplings from the first mast section; and retracting the actuators. In another aspect, the method also includes arranging a second mast section on the mast cart, the second mast section having a second mast upper section and a second mast lower section; engaging the plurality of couplings to the second mast section; extending the actuators to lift the second mast section, using the couplings, in a vertical direction towards the floor; connecting the second mast upper section to the first mast lower section; detaching the first mast section from the platform; extending the actuators to lift the first mast section and second mast section, using the couplings, in a vertical direction; attaching the second mast lower section to the platform using the plurality of holding locks; disengaging the plurality of couplings from the second mast section; and retracting the actuators. In another aspect, the method also includes repeating the arranging, extending, engaging, detaching, retracting to lower the respective mast section, attaching, disengaging, and retracting of the actuators until the plurality of mast sections has been attached to form the mast. In another aspect, the method also includes arranging a rotary section of the mast on the mast cart; extending the actuators towards the floor; engaging the plurality of couplings to the second mast section; detaching the second mast section from the platform; retracting the actuators to lower the second mast section and first mast section towards the mast cart; attaching the second mast lower section to the rotary section; extending the actuators to lift the first mast section, the second mast section, and the rotary section, using the couplings, in a vertical direction; attaching the rotary section to the platform using the plurality of holding locks; disengaging the plurality of couplings from the second mast section; and retracting the actuators. In another aspect, the actuators are each selected to include a hydraulically telescoping cylinder. In another aspect, the mast cart is selected to include a base to accommodate the plurality of the mast sections, the base being a quadrilateral surface having four corners with the corresponding actuator located near each corner. In another aspect, the floor is provided with an opening through which the first mast section, the actuators, and the couplings extend. In another aspect, the holding locks are located near the opening and each of the holding locks corresponds to one of the actuators. In another aspect, each coupling is located on an upper section of the corresponding actuator.

The present disclosure also introduces a method including arranging a first mast section of a mast on a mast cart below a floor of a platform, the mast including a plurality of mast sections; elevating, using actuators located on the mast cart, the first mast section through an opening in the platform; attaching the first mast section to the platform using a plurality of holding locks located on the platform; arranging a second mast section on the mast cart below the floor of the platform; elevating the second mast section, using the actuators, to the first mast section; attaching the first mast section to the second mast section; detaching the first mast section from the platform; elevating, using the actuators, the first mast section and the second mast section through the opening; and attaching the second mast section to the platform using the holding locks. In another aspect, the method also includes arranging a rotary section on the mast cart below the floor of the platform; supporting, using the actuators, the first and second mast sections; detaching the first and second mast sections from the holding locks; lowering the first and second mast sections, using the actuators, onto the rotary section located below the opening; attaching the rotary section to one of the attached first and second mast sections; elevating the first, second, and rotary sections, using the actuators, through the opening; and attaching the rotary section to the platform using the holding locks. In another aspect, the actuators are selected to include hydraulically telescoping cylinders. In another aspect, the mast cart is selected to include a base to accommodate the plurality of the mast sections, with the base being a quadrilateral surface having four corners with an actuator is located near each corner. In another aspect, the plurality of holding locks are located near the opening and each holding lock from the plurality of holding locks corresponds to one of the actuators.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus, comprising:

a base adapted to accommodate a first mast section of a mast configure to attach to a platform:

a plurality of actuators extending in a vertical direction from the base, the actuators adapted to apply a force in the vertical direction and being extendable and retractable along a vertical axis; and a coupling located on a corresponding actuator from the plurality of actuators, the coupling arranged to temporarily engage the first mast section and to convey the force from the corresponding actuator to move the first mast section along the vertical axis in connection with extension of the actuators;

wherein the actuators are extendable to a first height corresponding to a first position at which a lower section of the first mast section may be attached to the platform; and wherein the actuators are retractable to a second height corresponding to a second position at which the couplings disengage from the first mast section that is attached to the platform.

2. The apparatus of claim 1 wherein the actuators comprise hydraulically telescoping cylinders.

3. The apparatus of claim 1 wherein the base is a quadrilateral surface having four corners and having each corresponding actuator located near each corner.

4. The apparatus of claim 1 wherein each coupling is located on an upper portion of the corresponding actuator.

5. The apparatus of claim 1 wherein the platform comprises at least two vertical supports and a floor that connects laterally between an upper portion of each vertical support;

wherein the first mast section further has an upper section, and a second mast section has an upper section and a lower section;

wherein the base is located below the floor of the platform and between the vertical supports;

wherein the platform has a plurality of holding locks to attach the lower section of the first mast section to the platform;

wherein the base is configured to accommodate the second mast section;

wherein the hydraulically telescoping cylinders are extendable to a third height corresponding to a third position at which the upper section of the second mast section may be attached to the lower section of the first mast section so that the first mast section may be detached from the platform using the plurality of holding locks; and wherein the hydraulically telescoping cylinders are extendable to a fourth height corresponding to a fourth position at which the lower section of the second mast may be attached to the platform using the plurality of holding locks.

6. The apparatus of claim 5 wherein the floor has an opening through which the first mast section, the actuators, and the couplings can extend.

7. The apparatus of claim 6 wherein the plurality of holding locks are located near the opening, and one of the plurality of holding locks corresponds to one of the plurality of actuators.

8. The apparatus of claim 5, wherein the actuators are retractable to at least a fifth height corresponding to a fifth position at which the lower section of the second mast section may be attached to a rotary section; and wherein the actuators are extendable to a sixth height corresponding to a sixth position at which the rotary section may be attached to the platform using the plurality of holding locks.

9. A method, comprising:

locating a mast cart below a floor of a platform, the platform comprising a plurality of holding locks adapted to attach a mast thereto;

arranging a first mast section of the mast on the mast cart, wherein the mast comprises a plurality of mast sections, with the first mast section having a first mast upper section and a first mast lower section;

engaging the first mast section to a plurality of couplings, each coupling located on a corresponding actuator of a plurality of actuators that extends vertically from the mast cart, with the plurality of actuators extending and retracting, and exerting a force, in the vertical direction;

extending the actuators to lift the first mast section, using the couplings to convey the force exerted by the actuators, in a vertical direction towards the floor;

attaching the first mast to the platform using the plurality of holding locks;

disengaging the plurality of couplings from the first mast section that is attached to the platform; and retracting the actuators.

10. The method of claim 9 which further comprises:

arranging a second mast section on the mast cart, the second mast section having a second mast upper section and a second mast lower section;

engaging the plurality of couplings to the second mast section;

extending the actuators to lift the second mast section, using the couplings, in a vertical direction towards the floor;

connecting the second mast upper section to the first mast lower section;

detaching the first mast section from the platform;

extending the actuators to lift the first mast section and second mast section, using the couplings, in a vertical direction;

attaching the second mast lower section to the platform using the plurality of holding locks;

disengaging the plurality of couplings from the second mast section; and retracting the actuators.

11. The method of claim 10 which further comprises:

repeating the arranging, extending, engaging, detaching, retracting to lower the respective mast section, attaching, disengaging, and retracting of the actuators until the plurality of mast sections has been attached to form the mast.

12. The method of claim 10 which further comprises:

arranging a rotary section of the mast on the mast cart;

extending the actuators towards the floor;

engaging the plurality of couplings to the second mast section;

detaching the second mast section from the platform;

retracting the actuators to lower the second mast section and first mast section towards the mast cart;

attaching the second mast lower section to the rotary section;

extending the actuators to lift the first mast section, the second mast section, and the rotary section, using the couplings, in a vertical direction;

attaching the rotary section to the platform using the plurality of holding locks;

disengaging the plurality of couplings from the second mast section; and retracting the actuators.

13. The method of claim 10 wherein each coupling is located on an upper section of the corresponding actuator.

14. The method of claim 9 wherein the actuators are each selected to comprise a hydraulically telescoping cylinder.

15. The method of claim 9 wherein the mast cart is selected to comprise a base to accommodate the plurality of the mast sections, the base being a quadrilateral surface having four corners with the corresponding actuator located near each corner.

16. The method of claim 9 wherein the floor is provided with an opening through which the first mast section, the actuators, and the couplings extend.

17. The method of claim 16 wherein the holding locks are located near the opening and one of the plurality of holding locks corresponds to one of the plurality of actuators.

18. A method, comprising:

arranging a first mast section of a mast on a mast cart below a floor of a platform, the mast comprising a plurality of mast sections;

elevating, using actuators located on the mast cart, the first mast section through an opening in the platform;

attaching the first mast section to the platform using a plurality of holding locks located on the platform;

lowering the actuators to disengage the first mast section that is attached to the platform;

arranging a second mast section on the mast cart below the floor of the platform;

elevating the second mast section, using the actuators, to the first mast section;

attaching the first mast section to the second mast section;

detaching the first mast section from the platform;

elevating, using the actuators, the first mast section and the second mast section through the opening; and attaching the second mast section to the platform using the holding locks.

19. The method of claim 18 which further comprises:

arranging a rotary section on the mast cart below the floor of the platform;

supporting, using the actuators, the first and second mast sections;

detaching the first and second mast sections from the holding locks;

lowering the first and second mast sections, using the actuators, onto the rotary section located below the opening;

attaching the rotary section to one of the attached first and second mast sections;

elevating the first, second, and rotary sections, using the actuators, through the opening; and attaching the rotary section to the platform using the holding locks.

20. The method of claim 18 wherein the actuators are selected to comprise hydraulically telescoping cylinders.

21. The method of claim 18 wherein the mast cart is selected to comprise a base to accommodate the plurality of the mast sections, with the base being a quadrilateral surface having four corners with an actuator is located near each corner.

22. The method of claim 18 wherein the plurality of holding locks are located near the opening and one of the plurality of holding locks corresponds to one of the plurality of actuators.

* * * * *

UNITED STATES PATENT AND TRADEMARK OFFICE

CERTIFICATE OF CORRECTION

PATENT NO. : 8,839,570 B1
APPLICATION NO. : 13/799903
DATED : September 23, 2014
INVENTOR(S) : Petrello et al.

It is certified that error appears in the above-identified patent and that said Letters Patent is hereby corrected as shown below:

In the Claims

Claim 1 at Column 6, line 63: Please change --configure-- to "configured".

Signed and Sealed this
Thirtieth Day of December, 2014

Michelle K. Lee

Michelle K. Lee
*Deputy Director of the United States Patent and Trademark Office*